United States Patent [19]

Gagle et al.

[11] Patent Number: 4,678,375

[45] Date of Patent: Jul. 7, 1987

[54] COVERING OR LINER SYSTEM AND METHOD FOR CONSTRUCTING THE SAME

[75] Inventors: Duane W. Gagle, Bartlesville, Okla.; Duane W. Gagle, Jr., Tulsa, Okla.; Richard L. Gagle, Broken Arrow, Okla.; Paul L. Gomory, Bethesda, Md.

[73] Assignee: Gagle Company, Inc., Broken Arrow, Okla.

[21] Appl. No.: 586,128

[22] Filed: Mar. 5, 1984

[51] Int. Cl.[4] ..... E02B 3/00

[52] U.S. Cl. ..... 405/270; 405/53; 405/128

[58] Field of Search ..... 405/53, 55, 128, 129, 405/258, 270, 16, 17, 19

[56] References Cited

U.S. PATENT DOCUMENTS

| | | | |
|---|---|---|---|
| 677,825 | 7/1901 | van Orden et al. | 405/19 |
| 2,143,461 | 1/1939 | Waring | 405/19 X |
| 3,283,518 | 11/1966 | Toffolon . | |
| 3,344,608 | 10/1967 | McEachran . | |
| 3,381,477 | 5/1968 | Scales . | |
| 3,461,673 | 8/1969 | Slover . | |
| 3,716,998 | 2/1973 | Nielson et al. | 405/19 |
| 3,943,721 | 3/1976 | Azalbert et al. | 405/53 X |
| 4,068,480 | 1/1978 | Lefever et al. | 405/270 X |
| 4,154,061 | 5/1979 | Umemoto et al. | 405/19 |
| 4,194,855 | 3/1980 | Egger | 405/128 |
| 4,344,722 | 8/1982 | Blais | 405/270 |
| 4,371,288 | 2/1983 | Borca et al. | 405/53 |

FOREIGN PATENT DOCUMENTS

| | | | |
|---|---|---|---|
| 2734525 | 2/1979 | Fed. Rep. of Germany | 405/270 |
| 45684 | 11/1980 | Japan | 405/19 |

OTHER PUBLICATIONS

"Equipment You Ought to Know About—Irrigation Canal Liner", Excavating Engineer, Nov. 1951, pp. 50 & 51.

*Primary Examiner*—David H. Corbin

[57] ABSTRACT

A liner or cover system is provided, which can at times have at least a portion of its area exposed to wind and/or ground fluid action and consequent damage, and which is held in position against dislodgement and therefore against damage by said action by an anchoring means or structure. The system is held anchored from under it at a plurality of loci by said anchoring means or structure which exerts at each said loci a force at least equal to the maximum force of wind and/or ground fluid expected to act at any time at said loci independently from any force acting at any time at any other of said loci of said liner or covering. Also, there is provided a method for constructing said system which includes among its steps bringing together at least two sections or laps to be incorporated to form said liner or cover, joining the laps to form at least a portion of said liner or cover or system, and anchoring said liner or cover from below it at a plurality of loci to form at least a portion of said liner or covering. The loci at which anchoring is effected are distributed at least across the exposed area of the liner or covering, preferably in a grid-like pattern. Several embodiments of the system are included within the description, drawings and the claims. In use, the system can contain, retain or fend off fluid or liquid from contact as with the ground or other substance to be covered as in an impoundment, channel and/or in the prevention of evaporation of a liquid, e.g., water, or collection of a fluid, e.g., geothermal steam, or e.g., storage of agricultural products.

29 Claims, 13 Drawing Figures

COVERING OR LINER SYSTEM AND METHOD FOR CONSTRUCTING THE SAME

This invention relates to a ground covering or liner system. It also relates to a method for constructing such a cover or liner system. Other substances can be covered, e.g., water.

In one of its aspects the invention provides an improved earth liner or covering structure system resistant to displacement by action of wind and/or earth fluids.

In another of its aspects the invention provides a method or procedure for in situ laying or constructing an earth liner or covering. In a specific embodiment of the invention there are provided a pond liner and method for so constructing the same which will assure that any portion of the liner, even when initially substantially empty, or even under construction, will not be dislodgeable by action of wind and/or a ground fluid.

In a still further aspect the invention provides a system and method for constructing and installing the same in situ which is pre-eminently stable in place and is adapted to contain or fend off a liquid, or like material, thus preventing said liquid or material from contacting and/or being absorbed by the earth upon which it is installed, the system having co-acting elements at least one of which co-acts with the earth and with at least a portion of said system to stabilize it against dislodgement while providing adequate drainage away from under said system of any earth or ground fluid.

In another aspect the invention provides a combination of elements in a liner or ground covering system which, while holding said system in place against dislodgement also permits the much better functioning of provided ground fluid eductors which are known in the art.

In another of its aspects the invention provides a pit, pond, ditch or channel liner system using as liner a flexible or plastic sheet-like material, e.g., a non-woven fabric of polypropylene, polyester, nylon or other synthetic constituency which may be coated with an impermeable material such as polyethylene, rubber compounds, chlorinated polyethylene, polyvinylchloride, and other synthetic coatings suitable for reinforcing with a non-woven fabric backing. In another of its aspects the invention provides a method for lining a pit, pond, ditch or channel by constructing therein a lining system or structure using such a flexible material as herein described stable against action of wind and/or ground fluid even when said structure is not weighted down by any material or liquid therein, e.g., a ballast material or stored liquid, as in an impoundment containing a pool of water.

BRIEF SUMMARY OF INVENTION

The invention provides an open-top liner or ground covering system, open above a substantial portion of its area to the atmosphere and subject to action of wind and gusts of wind acting upon its upper surface and therefore to sudden strong suctions and consequently to buffeting and/or subject to upward thrusts by ground fluid, which comprises a liner in a laid-out position above the surface of the ground; retaining or holding means adapted to attach retainingly to the underside of said liner, a plurality of said holding means being attached to said underside of said liner, at least one said holding means being attached respectively to at least one of a plurality of loci on the underside of said liner, said loci being distributed in a grid-like manner over substantially the entire surface area of said underside of said liner; at least one anchoring means below said liner adapted to retainingly attach to and to hold said retaining or holding means substantially immobile against any wind or fluid acting on said liner; each said retaining or holding means being attached to at least one said anchoring means and co-acting therewith, the co-acting holding means and loci and anchoring means being of a number and each of a strength sufficient that the co-action at each loci will be such that said liner and each portion or loci thereof is held firmly in said laid-out position against the strongest expected action of said wind and/or said ground fluid at each of said loci.

The invention also provides a method for constructing a cover liner or ground covering system which comprises: laying on the ground, one atop the other, at least two liner sections or laps, at least one edge of each lap being adjacent an edge of another; attaching an edge of one of said laps to the edge of the other, as by seaming or bonding, thus to form a joint or seam, which can be selvage-like; providing an anchoring element below said joint or seam; providing a retaining or holding element; attaching or interconnecting said joint or seam and said anchoring element in a fixed, immobile relationship by attaching said retaining or holding element to said joint and to said anchor; and then folding the top lap over said joint and onto the ground thus covering said joint and said ground.

PRIOR ART

Figure 1:
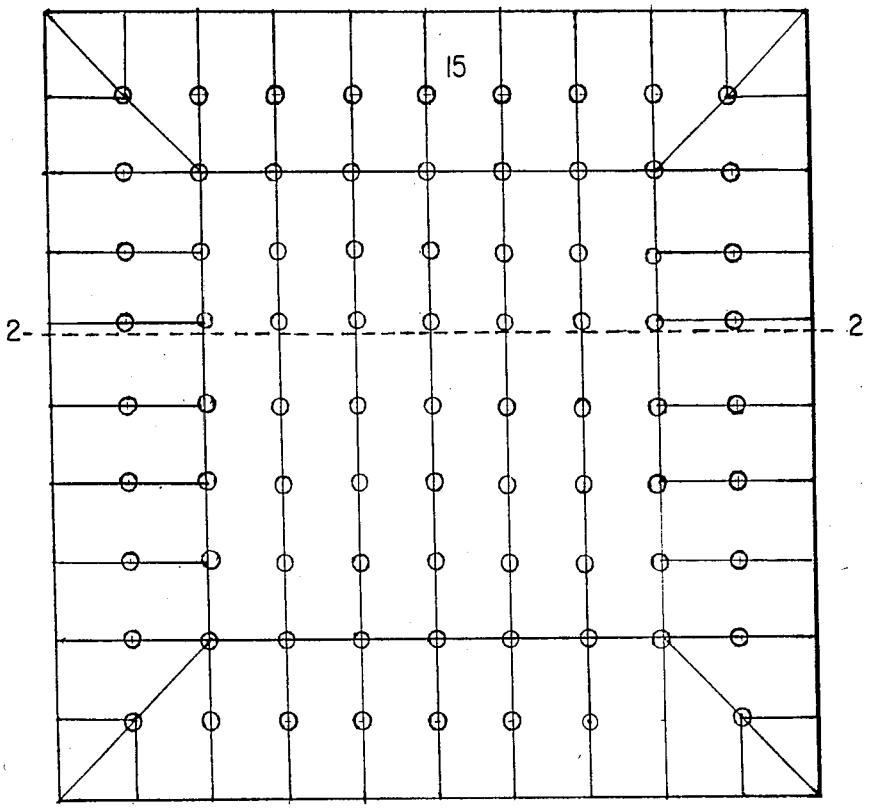
FIG. 1 is a plan view diagramming an impoundment embodiment of the invention in which a liner is held down by holding means disposed substantially in a grid pattern.

Attempts to hold a flexible, e.g., plastic liner in place against dislodgement against wind and/or ground fluid have included use of a ballast material, e.g., crushed rock, bentonite clay and even used tires, etc., as covers and even expensively built structural means providing a suction below the liner. Such attempts for one reason or another have not been satisfactory and even have resulted in failure of some kind as is known in the art. It is known that a liner can accumulate underneath it a gas forming a gas-filled pocket or bubble which can cause the liner, even when containing a liquid stored therein, to rise up to and even above the surface of the stored liquid.

SOME OBJECTS OF THE INVENTION—GENERAL DISCUSSION OF SOME PROBLEMS, ETC.

It is an object of this invention to provide a liner or cover structure. It is another object of this invention to provide a liquid impermeable liner or ground cover structure stabilized against dislodgement by wind and/or ground fluid action—e.g., air, gas, water, etc., without the use of ballast of any kind above the storing liner, suction, etc.

Thus, it is an object of the invention to provide a structure which can be applied to position in a fixed manner a geomembrane liner to prevent loss to the ground of contained fluid or liquid as from a containment basin, pit, channel, ditch, etc. A further object is to provide a method for constructing a geomembrane liner.

Some problems which have been encountered in the prior art include lifting of the liner by high wind velocities which create negative pressures or vacuum, in many cases seriously damaging the liner and even completely blowing it away; flotation of the liner by gases such as methane, carbon dioxide, hydrogen sulfide, etc., which are generated from decomposition of organic material in the ground formations under the liner, or even entrapped air; flotation of the liner by ground water pressures; and lap joint failure caused by fatigue from liner weight, as on side slopes, combined with the energies of contraction and expansion from heat and cold and the working of wind and wave action.

It was conceived by us to anchor a liner from underneath by providing a structure including ground anchors fixed by ropes to the underside of the liner. Some anchors or ropes were dislodged or broke away allowing the flexible liner material to be dislodged from the basin and seriously injured, even blown away.

It was later conceived that the number of anchors and the anchor rope strengths were intimately related to the portion of surface area or loci of the liner which these were to hold down in place against dislodgement. Further, it was found that the rope strength had to be quite large, indeed much larger than had been expected, even after the earlier installation had been dislodged and wind-injured. Further, it was found a relationship, between the basin depth, direction of and wind velocity such that the forces at play during a strong blow, especially coming in gusts subjected the liner to sudden buffeting and consequent jerking which had to be compensated, existed which had not been priorly conceived.

Further, it has now been appreciated that the hold-down strength, pull, or weight acting upon the liner or laps or sections of it, as the liner is being laid or when substantially empty after it has been installed, to prevent its dislodgement and even possible destruction must be far greater than earlier thought would be necessary. Thus, the forces acting at the portion or place of the wind suction expected or the experienced upward thrust created by the wave or waves of wind which tend to buffet the liner were found to be larger by far than had been anticipated. Also, we have found that during attack by the wind the liner needs to be held, as it were, successively at a series of points, places or portions, each of which must be able to withstand, at times virtually alone, the effects of the wind and/or the effects or upward thrust of ground fluids, e.g., liquids, gases, air, etc. Still further, to the extent a portion of the liner subject to a sudden gust of heightened intensity may move and thus acquire momentum, the force or sudden jerking effect thus created must be absorbed without rupture of the liner retaining member and/or anchor element, whatever their natures.

We have conceived a system for lining, say, an impoundment as well as a method of in situ constructing the same, the system having such force withstanding properties that the cost of its structure and installation lend themselves to a truly economic operation.

Thus, the present invention offers solutions to the problems encountered in emplacing or installing a liner or covering as when laid in sections, laps, or panels into position as in impoundments, canals, ditches, as in the storage and/or conveying of fluid, or in preventing soil erosion by covering the ground to prevent washaway either on horizontal or inclined surfaces, or both.

DETAILED DESCRIPTION

The invention provides a method for constructing a barrier against loss into or contact of fluids with the earth as from a storage of fluid, for example in an impoundment or the storage and conveying of a fluid in a canal, irrigation ditch, or in soil erosion prevention. It also provides the resulting structures or systems, useful to cover earth, water or other substance.

Considering present day problems, almost daily increasing in their importance, especially in the areas of pure water, pollution control as well as in the needs of industry, agriculture and public works, etc., the claimed invention finds applicability to solve effectively and relatively economically environmental problems, including the immense need for conservation, as well as needs evident from the following applications given by way of example.

The invention finds a number of applications in industry, agriculture and public works as follows: aeration lagoons, brine storage, ponds, cooling ponds effluent storage ponds, evaporation ponds, floating covers, hazardous waste collection ponds, oil spill confinement, ore leaching pads, oxidation ponds, process water storage, reservoirs and dams, settling basins, sulphite liquor storage ponds, tank linings, thickeners, waste treatment facilities, artificial lakes, beach erosion protection, canal linings, cutoff curtains, dams and dam cores, embankment protection, floating reservoir covers, levee protection, reservoir linings, sanitary landfill leachate control, sewage digestors, sewage lagoons, skating rink liners, animal waste storage, fermentation vats, grain storage pads and covers, irrigation canals and reservoirs, rain catchment cisterns, stockwater ponds, trench silos and water storage.

The lining system of the invention avoids the problems associated with many existing lining or cover systems.

According to the invention there are provided a liner system and a method for constructing the same, said liner usually being open to the atmosphere over a substantial portion of its surface and being adapted to cover the ground to retain or contain fluid materials or to cover other substances, e.g., water in evaporation control, the liner system being stabilized against motion, fatigue or dislodgement and consequent failure caused by expected forces, e.g., wind and/or ground fluids, e.g., water, vapor, and/or gas, the method comprising laying at least a portion of a liner section, lap or panel upon the ground onto or into which loss of fluid is to be prevented, as at the bottom of a basin in the ground in which the system is being constructed; providing a liner anchor element or structure positioned below the level of said section; at a plurality of loci, at at least one edge of said section, fixing said anchor element or structure onto or into the ground; attaching said section at each of said plurality of loci to said anchor element or structure; the retaining force of the anchor element or structure provided at each loci of said section being related to the maximum force expected to act at any time upon any portion or loci of said liner system, thus providing at each such portion or loci an anchoring force having a resistance offered from underneath said section to prevent any substantial dislodgement of said section, said resistance being at least equal to said maximum force; any attachment of said anchor element or structure to any portion of said section being able to withstand without rupturing or breaking the greatest of said expected force.

Usually, and now preferred, several sections are attached as at or near their adjacent edges and the liner-retaining or holding members are fixed to the attached sections as at or near their attached edges; the provided retaining or holding members being disposed in a grid-like manner and being also fixed or attached to said anchor element or structure.

A feature of the invention of primary importance is the distribution over substantially the entire area under the exposed liner, when completed, of retaining or holding members of sufficient strength at a number of loci, preferably substantially uniformly distributed over said area, also sufficient to retain said liner in fixed position against dislodgement or motion, as described herein; said arrangement of retaining or holding members being herein referred to as "grid-like" or "grid arrangement", etc.

Another feature of the invention of primary importance, especially during the construction of the liner system, for example under windy conditions, is that the liner section can be and is fixed to an anchoring element or structure, say, as it is being unrolled; and the unrolled portion placed into position either on the ground above an already installed anchor which can have an anchor-like shape or above an earlier installed liner system, preferably constructed according to the present invention, which will function to hold down the unrolled portion which, in the now preferred mode of executing the invention, is attached at said loci even as each given length of it has been unrolled.

The invention will be further set forth and described particularly with respect to an impoundment system, it being understood that the system of the invention has broad application to other fluid containing or retaining systems as indicated herein.

Also, according to the invention, there is provided a liner system, as further described herein, which comprises upon its emplacement a construction and arrangement such that it will effectively resist motion while forming an effective barrier to loss of fluids into the earth, said system comprising a linear or covering, composed of several sections, laps or panels, attached, seamed or bonded together at their edges, said liner being held, fixed or anchored from underneath over substantially its entire exposed surface against upward or other motion, as when wind is exerting a suction, buffeting or other dislodging effect and/or when a ground fluid such as a gas, vapor, or liquid, e.g., water, is exerting an upward thrust against at least a portion of said liner; an anchoring element or structure below said liner; liner retaining or holding members attached to said liner and to said anchoring element or structure, said members being able to sustain without breaking a tension or pull-force at least equal to be expected to be exerted by said wind and/or fluid on said portion of said liner; said anchoring element being placed into or onto the ground or at least below an overburden at least disposed substantially at said seamed or bonded edges and presenting from underneath said liner substantially upwardly a sufficient profile portion and therefore a resistance to appreciable dislodgement or upward motion of the liner-retaining member at and therefore of said portion of said liner from its desired position, thus to retain said liner in said position by engaging with said profile a weight of said overburden at least equal to said dislodging effect or other such force.

According to the now preferred form of the invention the liner-retaining or holding members are attached to the liner at said seamed or bonded edges, more preferably to a selvage formed there, as later more fully described.

As employed in this application for patent the words "section", "lap", "panel", "portion", etc., synonymously indicate or describe parts or pieces of liner, liner material or covering, usually a flexible or pliable one, which are assembled as by seaming, stitching, bonding, etc., and anchored or fixed on location at the area or basin to be covered or lined.

Thus, the invention provides a much improved, indeed, quite satisfactory liner or covering the installation of which will dispose of or prevent from arising problems known in the art, said installation being readily and neatly as well as economically accomplished, relatively speaking. Thus, for rather large areas of application there is ease of handling, transporting, and installing the liner of the invention.

The installation method of the invention is conveniently accomplished without need for ballasting which would have to be provided and removed, usually requiring cleanup, etc.

Further, it is now evident that the system as it is being constructed in situ affords its own protection against wind, etc., of portions already emplaced.

According to the method of the invention a first panel is spread out and a second panel is substantially congruently spread upon it and stitched or otherwise attached by at least one of its edges to the corresponding edge of the panel below it, thus forming a seam or selvage in or to which an anchoring element or structure can be attached by means of a retaining or holding member or members; then or later fixing liner-retaining or holding members in or at the selvage either as it is formed or somewhat later; said holding members being held in a fixed relation with respect to the ground by an anchoring element, said holding members being disposed along said selvage in at least a number and of strengths sufficient to hold down their respective portions of said joined panels whereupon the upper juxtaposed panel is spread out over the ground in manner to cover the selvage portion of the respective edges of the two panels and to cover or to line more ground surface.

In one of its forms of execution the invention can comprise an anchoring means or element or structure comprising a sheet-like aspect, which can be like the liner, and even be of same or similar material, disposed below and, in one modification, spaced from the liner, the retaining or holding members at each of said loci being fixed to said liner and to said anchoring structure; said structure being weighted with a suitable weighting material, e.g., filler, earth, rocks, sand, a liquid or water, etc. A sheet-like anchoring structure can be a liner or cover earlier installed according to a method of the invention. Further, this earlier installed liner can be anchored also according to a method of the invention.

In another of its forms the anchoring means can comprise bag-like containers suitably weighted and to which the liner can be fixed as by retaining or holding members in a manner as described herein for fixing such members to the liner. Further, a number of such bag or box-like containers can be fixed together thus to form a unitary anchor structure.

Still further according to the inventon the anchoring element or structure whether constituted by a liner or by bags, etc., as just described, can be itself anchored to the ground even as described herein for holding down a liner.

Further still, the bags described can be provided with points of anchor element attachment. The bags can be fixed together by seaming, bonding, etc., and desirably can be so seamed as to provide a selvage to which a further anchoring element can be attached.

If the selvage has been produced by sealing or bonding, e.g., heat-sealing plastic containing panels, the joint at the selvage or seam will be impermeable when the heat-seal is continuous and has formed a bonding of the edges of the panel over their entire length. If not, asphalt or other sealant can be applied to the joint at the selvage or seam which in final position is upwardly exposed.

Still according to the invention a major portion or an entire ground covering or an impoundment structure is constructed of rot-proof plastic, e.g., polyolefin, polyester, etc. A laminate now preferred for execution of the invention is set forth, described and claimed in U.S. Pat. No. 4,035,543 issued July 12, 1977, Homer L. Draper; Duane W. Gagle, inventors, Bartlesville, Okla.

Further, according to the invention the retaining or holding members and even the anchoring element or structure are contemplated to be and have been made of such material as just named so that the overall structure is lightweight and resistant to ground or other fluids which act to destroy materials such as metals, for example.

When of a heat-meltable or sealable material the laps or panels can be attached, each to the other, or to others, by any suitable heat-sealing means or method.

Still further when joining the panels a selvage which can be formed by heat-sealing, stitching, or other bonding can be punctured as by a heated lance thus further sealing together at such a puncture the selvage portions and, advantageously, forming a grommet or grommets in situ whenever the material of the panels lends itself to this operation whereupon the attachment of the holding member or the anchoring element or structure can be fixed to the liner from below at said grommet or grommets. It is within the scope of the claims to otherwise fix the holding member or anchoring element to the underside of the liner panel before or even as these panels are being installed.

In the installation of the system there can be utilized various kinds of retaining or holding members and anchoring element or structure. Ordinarily, and now preferred, the holding members will be substantially disposed or positioned at loci over the entire surface to be covered in a grid-like disposition as earlier noted so that whatever their natures the holding members for a given installation can be each of them substantial duplicates of the others, thus permitting their production relatively inexpensively in a continuing operation and then shipped to location.

When the panels or laps are substantially of the same or similar shape, e.g., rectangular, the holding members preferably will be disposed in a substantially uniform grid arrangement so that each will act upon substantially the same size area or portion of the liner and so that calculations can be minimized and the number of holding members optimized.

Further, according to the invention, the anchoring element can be constituted by a weighted anchoring plate or a V-shaped anchor. Further, it can be lined, filled trench or ditch, etc., as further described herein.

When the anchoring element provided is a simple plate it can be, indeed preferably will be, a plastic plate sufficiently rigid and of a size to be retained fixed below an overburden without being pulled therefrom with the largest expected tension exerted upon it by the liner retaining or holding member attached to it. In one now preferred embodiment a plastic rope, e.g., of polypropylene of sufficient strength to hold down its portion of the liner is passed downwardly through a plastic plate positioned in an excavation or hole and knotted therebelow. Now preferred, the rope is passed from its point of penetration through the plate underneath the plate a substantial distance and brought up therethrough and knotted there above, thus distributing the pull of the retaining rope or member on the plate and reducing the force acting upon the knot. The plate can be of any shape. Now preferred the plate will be substantially square and will be laid horizontally in the hole which ultimately is filled with overburden of whatever kind exists or is chosen. The plate size will depend upon the nature of the overburden, its density and stability.

The other end of the rope can be brought up through the selvage through a grommet and there knotted or, preferably, for making a more secure attachment, it will be brought up through a plate juxtapositioned to the selvage and then knotted. More preferably, after passing through the selvage and the plate the rope will be extended along the plate and then brought down through the plate and selvage, then again extended now below the selvage and again brought up at a still different place through the selvage and the plate and knotted. During this operation the selvage can be and preferably is held in a substantially horizontal position so that the plate may be placed thereupon and the assemblage and the rope readily worked with. The place at which the rope ultimately is knotted along its length, and other conditions, are selected so that when the selvage has assumed essentially a vertical position, assuming the ground or surface on which it rests ultimately yields to it, the rope will be taut and firmly held by the anchor element or structure. A plurality of anchoring elements or structures can be rope connected each of them through one or more grommets and corresponding plates at the selvage.

The bag or box-like container, when rope connected to the liner as to a selvage thereof, preferably is wrapped around the bag or box which is laid in position whereupon the rope is fixed to the selvage as herein described.

When the anchoring element or structure is a trench or ditch, say box-like in elevational cross section, which is now preferred, the trench is established and plastic or other preferably permeable, e.g., filter fabric lining is so laid thereinto that at least opposite sides thereof sufficiently extend ultimately to fold over and to cover the trench. One of the portions covering the top of the trench can be, and preferably will be, stitched or otherwise bonded together with the selvage either as the selvage is being formed or thereafter. The opposite side of the filter fabric is now lapped over the trench, the selvage and the attached portion of the filter fabric are laid across the just laid lap and the upper liner section folded over thus covering the trench, etc., as further evident from the drawings. Prior to lapping over the filter fabric the trench, if it is to act as a drainage conduit is provided with an impermeable liner extending across its bottom and up the side walls for a sufficient distance to provide said conduit. Or, the impermeable liner can be placed in the trench prior to installing the filter fabric. A cap or filter fabric covering atop the portion of the trench acting as drainage conduit is provided to prevent permeation into the drainage conduit of particulate material which may be thereabove as when additional weighting material is used to further fill the trench or which may over a period of time migrate into the trench. To further ensure good drainage drain tile is disposed the length of the trench and is arranged to drain off to a suitable place thus to keep stable the soil or ground beneath the liner. Finally, if stitching has been done a sealing material e.g., asphalt or hot melted plastic, e.g., polyolefin etc., can be used to render the joint liquid proof or it can be heat-sealed.

When the anchoring element is a V-shaped member it can be formed of plastic by extrusion, heat-forming, or by physical bending. The hole or trench and size of this member are proportioned each to the other and to the maximum expected pull of the liner at the locus so that upon such pull the V will open and lock against the sides of the hole so that the undisturbed wall of the hole and the overburden will co-act upon the now open V to retain it in its present position. This locking of the V can be accomplished by pulling on the rope before it is attached at its upper end to the selvage. Simply, a pipe and fulcrum can be used to provide the locking of the V.

In one modification of the invention such anchors as are described herein and which can be adapted to be positioned in the described trenches can be so positioned.

Still according to the invention holes into which anchors are positioned, or some of them, can be made to intersect with one or more others of like or different structure thus providing a drainage system for fluids and/or conduction of gases toward at least one side of the structure, thus to avoid upward thrust upon the liner and/or loosening of the ground thereunder due to the action of such fluids.

The invention provides the best desired functioning of peripherally placed eductors of the art because pressure of air entering at one side, especially of a large pond, will not be entrapped under the liner to cause it to billow, the structure of the liner system of the invention holding the liner firmly in place, etc. As used in the prior art the eductors permit a billowing to be caused and such billowing could co-act with the wind and/or ground fluid to dislodge, if not actually harm or destroy, the liner.

Further still, according to the invention, when the anchoring element is a ground cover or further liner disposed beneath a top liner and at some distance therefrom, there can and preferably will be provided at spaced intervals drainage elements, conduits or pipes to drain away fluids which otherwise would accumulate between the liners.

When the anchoring elements are bag or box-like or have some other container form these can be disposed in manner to espouse drainage elements, conduits or pipes to prevent accumulation of unwanted fluid beneath the liner. For example, if the conduits are inter-connected or bonded together to form a unit or units drain tile can be and preferably is laid before the containers are connected as at their upper portions as by bonding, heat-sealing, stitching etc.

An important feature of the invention resides in the incorporation of the retaining or holding members at the time of the joining of the edges of the panels. Thus, regardless of the number of laps or panels needed to suitably cover economically an area the holding down from underneath can be effected at loci in sufficient and optimum number in a simple manner.

The invention and its several embodiments now will be described with the aid of the several figures of the drawing, it being understood that the figures are largely diagrammatic in nature and that combinations of the various elements other than the combinations shown can be made. Also, that variations of the provided elements or means are within the scope of the appended claims.

Referring now to FIGS. 1, 2, 3, and 4 of the drawings liner 15 is held by in-ground anchors 16 which are attached by ropes 17 and plate 18 to selvage 19, the rope passing through plate 18 through holes which correspond to grommets 20 is selvage 19. The rope is knotted at both its ends. The lower knot is made before anchor 16 is set. Then rope 17 is pulled taut to set the anchor 16, as described elsewhere herein. Then rope 17, plate 18 and the selvage 19 are brought together tightly and the upper knot made as shown. In final position the selvage espouses the ground and it is in this position that the upper knot is established, thus to avoid any appreciable movement of the selvage and therefore of the liner.

It will be appreciated by one skilled in the art studying this disclosure that before the anchor is set selvage 19 and therefore the panel or section on the bottom will be drawn transversely of the selvage to tightly stretch the liner into final position of said bottom section. The selvage now presses against the ground or aggregate below it to which it is firmly and securely held.

It is within the scope of the claims to use in any installation any combination of retaining or holding members, e.g., rope, selvage and/or plates. Thus, more than one anchor means or structure can be used to anchor one retaining member or a plurality thereof. Also, more than one retaining member can be used or attached to only one anchor means.

Figure 5:
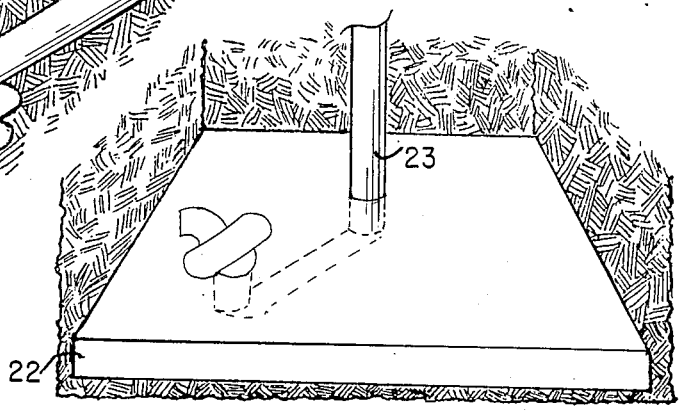
FIG. 5 is an isometric view of a plate-type, in-ground anchor and a rope attached to it.

FIG. 5 shows a plate-like in-ground anchor 22. In this case a rope 23 is passed as shown through two holes in plate 22 and knotted above the plate. The passing of the ropes through the various grommets and holes shown will reduce the tension affecting the knots. The holes and/or grommets through which rope is passed and against which rope is urged will be formed to avoid sharp edges cutting into the rope as it works to hold the liner against wind action, etc.

The choice of combinations of elements of the liner structures of the invention will depend upon the nature of the soil or ground, aggregate and/or filler materials used, etc. It will be appreciated that coverings or impoundments can be quite large and that the natures of the soil or even available aggregate may vary over the surface onto which the liner is to be anchored.

Figure 6:
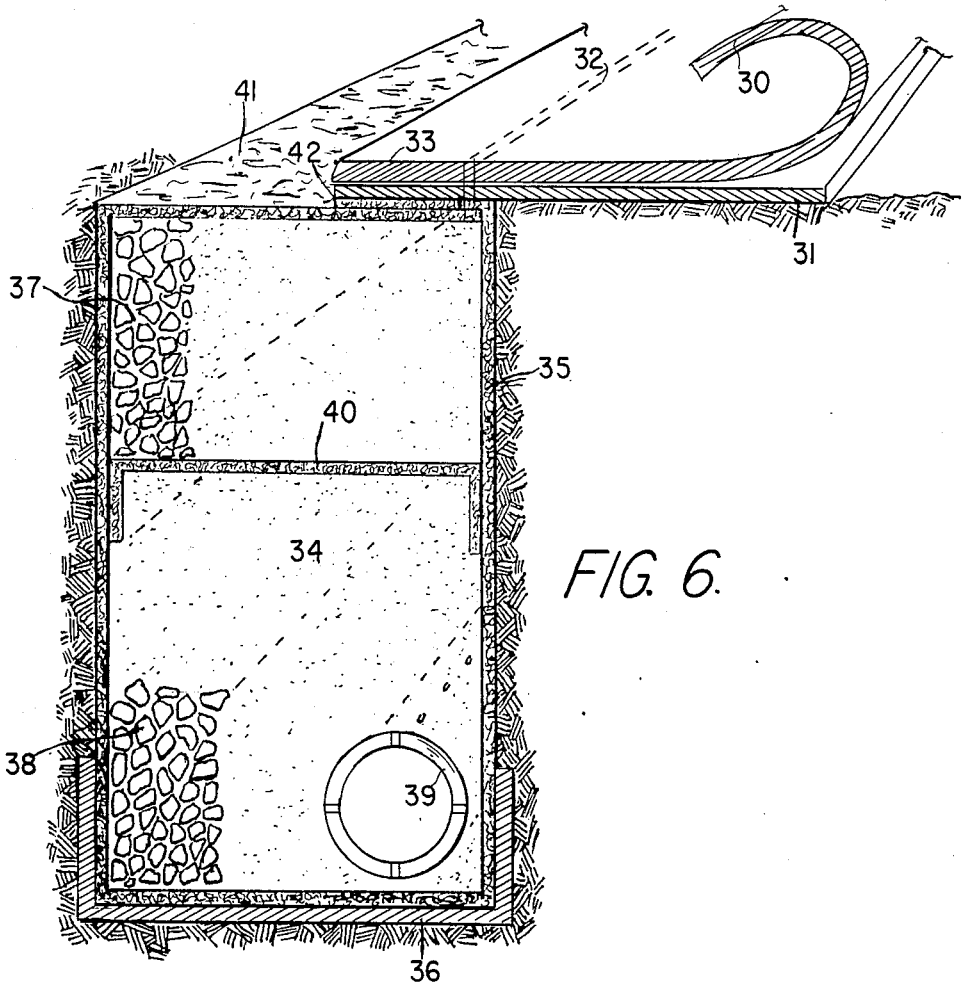
FIG. 6 shows a trench, drainage ditch having a filter fabric lining or walls which extend at the top above the ditch and is there joined to two superposed liner laps, and a protected drainage conduit portion.

Referring now to FIG. 6 two liner laps 30 and 31 are shown seamed together by seam 32 forming selvage 33. In the embodiment described the laps are held to drainage ditch 34 by being stitched or otherwise bonded at selvage 33 to the top portion of filter fabric liner 35. As shown, the stitching has been made at the same time through the liner laps and the filter fabric. The trench is provided with a liquid impervious bottom or trough 36 to provide for draining away from below the liner a ground liquid. There can be disposed in the trench additionally to the aggregate shown at 37 and 38, which can substantially fill the trench, drain tile 39 as well as a drainage conduit covering material or cap 40 which can also be of a filter fabric material effective to prevent accumulation of fine particulate material in the drainage aggregate 38.

As shown, filter fabric 35 is preferably of size and shape to substantially fill the trench, or ditch, and to overlap at the top of the ditch. Study of the figure will show that as the selvage is being stitched and/or bonded to the filter fabric, it and the fabric can be held in a more or less upright posture and therefore handleable from both sides or faces of the double or triple layer of material being stitched. Upon filling of the ditch, portion 41 of the filter fabric is lapped over whereupon liner section 30 is lifted over and stretched across the top of the ditch ready for further selvage forming and anchoring to an anchoring means or structure of the invention. To ensure that uplift force will be effectively countered, the stitching at seam 32 should be substantially above the filter fabric liner 35 wall. The seam is shown in the drawing to one side of the wall by just a little bit for sake of clarity when studying the structure depicted. If desired, a beading of sealant can be run along the top of lap 41 along the longitudinal edge of the selvage thus to hold together laps 41 and 42 and, of course, the selvage. The seaming can be made at the top end of the wall which is vertical while the wall and the selvage are vertical if a slight remaining ridge when section 30 has been folded over is not significant.

In the event additional anchoring means may be desired to be placed in the trench such anchor can be disposed in the fill above cap 40 to hold down the selvage along with portion 42 or the upper end of the filter fabric, as described. Further, there can be a combination of anchoring means or structure and selvage other than that shown in FIG. 6 and a drainage tile or other structure in which event the stitching shown in FIG. 6 can be dispensed with.

Figure 2:
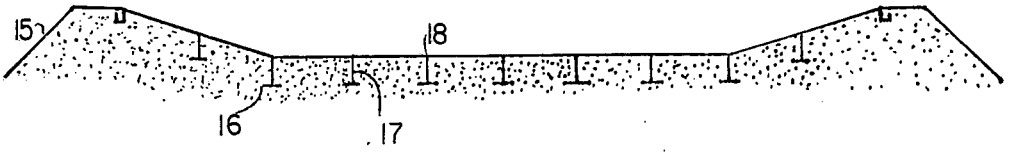
FIG. 2 is an elevational cross-section of FIG. 1 along line a—a, also showing the perimeter of the impoundment into which the liner edge is buried in a trench.
Figure 3:
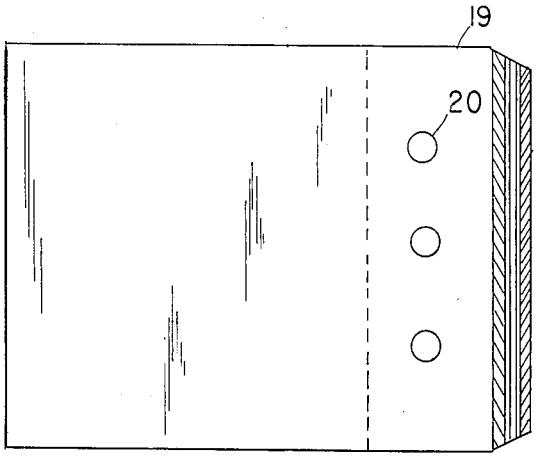
FIG. 3 illustrates a formed selvage joining together portions of two laps of liner material, the selvage having been grommeted.
Figure 4:
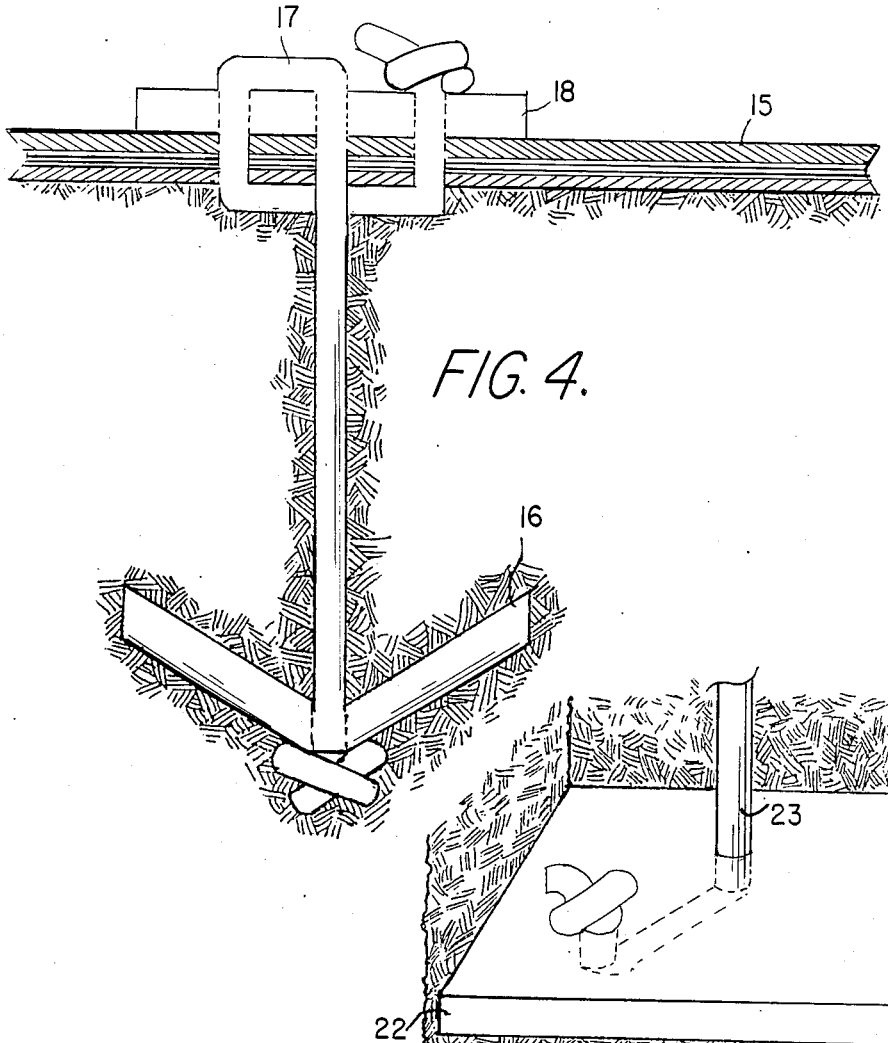
FIG. 4 shows in elevational cross-section an in-ground, V-shaped anchor, rope-attached to a liner.
Figure 7:
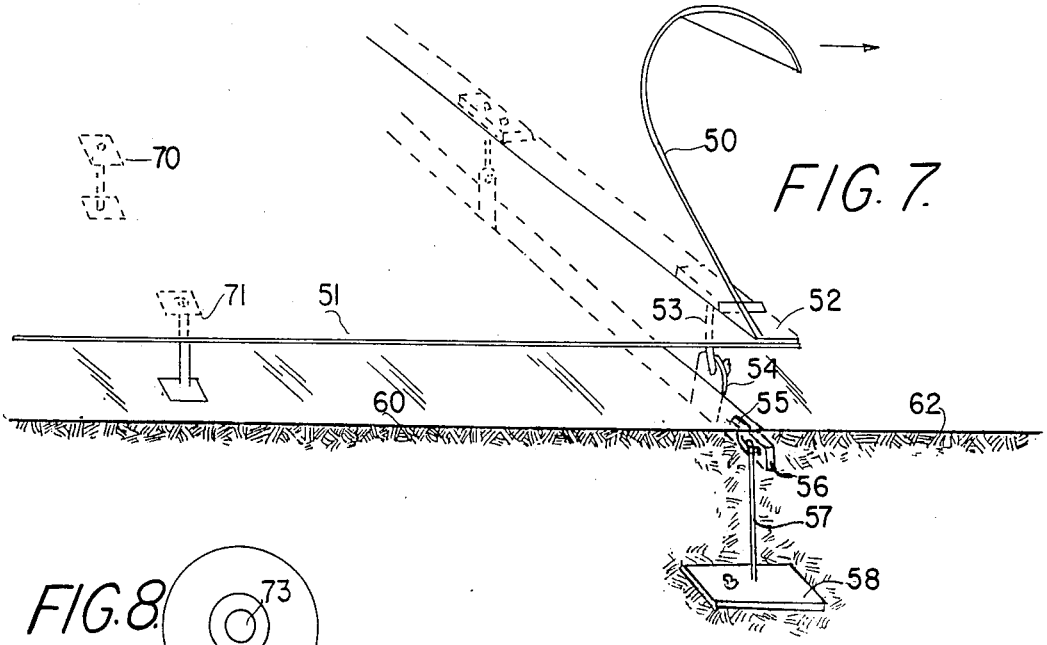
FIG. 7 is an isometric view of a multiple, in this case double, liner embodiment in which a top liner is held down by at least one type of holding member in a fixed relationship to a lower liner which in turn can be anchored with an in-ground anchor.
Figure 10:
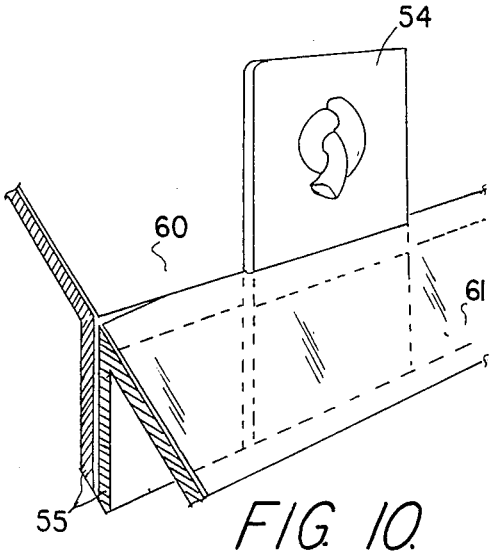
FIG. 10 is an isometric view of some details of a seam-held web which can form part of a rope anchoring.

Referring now to FIG. 7 liner laps 50 and 51 are joined to provide selvage 52 held tautly by rope 53 to web 54 stitched into selvage 55 (FIG. 10) held by plate 56, rope 57, and anchor 58 substantially as described in connection with FIGS. 2 and 5 which show plate 18, ropes 17 and 23 and anchor plate 22. Still referring to FIG. 7 laps 60 and 61, joined or bonded at selvage 55, forming the same, produce a lower liner or ground covering. The manner of holding the liner portion formed by laps 50 and 51 to the liner portion formed by laps 60 and 61 can be different from that shown. Preferably, basically, the structure will be as shown. Further, trenches or drainage ditches cn be provided below the lower liner or between the two liners or in both places, thus to effectively control, drain, or conduct away ground fluid which otherwise will become entrapped below either one or both liners. For example, tons of fill or aggregate emplaced under conditions of severly low temperature or precipitation can later emit vapors or even air which should be removed.

Figure 8:
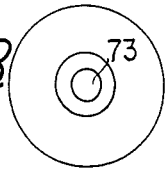
FIGS. 8 and 9 respectively show in plan view and in elevational cross-section some details of an escutcheon-based rope attachment.
Figure 9:
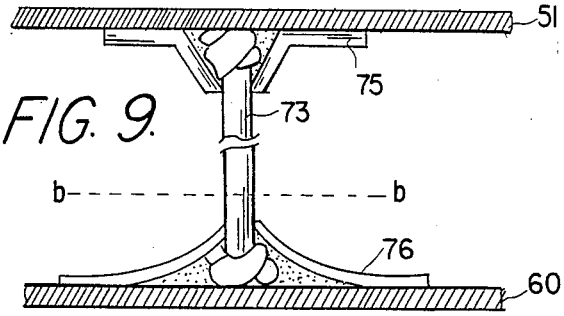

Referring now to FIGS. 8 and 9, FIG. 8 is a plan of a cross-section taken along line b—b of FIG. 9. FIG. 9 shows some details of liner attachments diagramed in FIG. 7 at 70 and 71. FIG. 9 shows segments of liners 51 and 60. A rope 73 is respectively passed into an escutcheon or retaining pad at each of its ends and therein knotted. The escutcheons, 75 and 76, can be stitched or bonded to sections 51 and 60 to assume the positions shown at 70 and 71, which show square pads rather than circular ones of FIG. 9.

After the structure just described has been accomplished section 50 of FIG. 7 is pulled in the direction shown by the arrow, thus to be laid out, ultimately, over section 61 for a repetition of earlier steps and structure described in connection with this figure.

The length of rope 73, knotted and in final position, as bonded to the liner sections will additionally to ropes as a 53 hold the two liner layers, each to the other, producing and maintaining a fixed distance between them. The bonding of the escutcheons is done even as the upper liner portion is moved over the bottom liner portion which has been pre-laid. The number of structures of the kind, or other, depicted in FIGS. 7, 8 and 9 which are placed as at 70 and 71 in FIG. 7 is selected to hold down the upper liner against jerking produced by wind buffeting earlier described herein. Critically, the rope at each locus will be of strength sufficient to overcome the force which otherwise would lead to jerking, thus to avoid substantially the gaining of momentum of the upper liner, momentum having been earlier referred to herein. Although a rope made of rot-resistant plastic, e.g., polypropylene is now preferred as being most economical certainly in the long run, in lieu of rope 73 there can be used a rod or cable the ends of which can be nut or clamp secured. It is not unusual now to find nuts and bolts made of synthetics which can be threaded and screwed together. Thus, plastic rods and corresponding nuts can be used and provision made in the escutcheon for their tightening.

Figure 11:
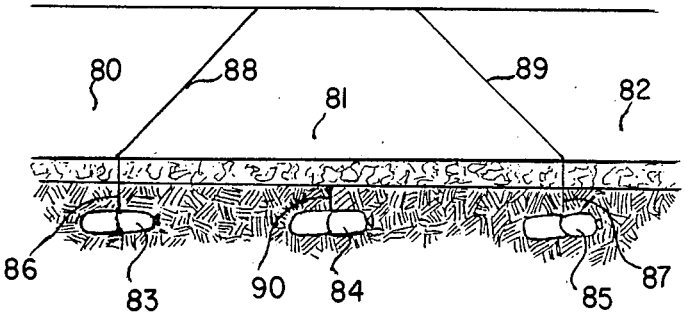
FIG. 11 is in part an isometric and in part an elevational cross-section of in-ground or aggregate containing bag-like anchor means.

FIG. 11 shows joined liner panels 80, 81, and 82 held down by in-ground bag-like or ballast anchors 83, 84, and 85. The reader will have noted that bags 83 and 85 have ropes 86 and 87 tied respectively around them, the ropes being fixed into seams 88 and 89. Rope 90 wrapped around bag 84 is fixed to liner 81 at a locus between its edges. Any manner of fixing rope 90 can be chosen. Preferably, a structure as described earlier herein as in connection with the description of FIGS. 7, 8, and 9, can be used.

Figure 12:
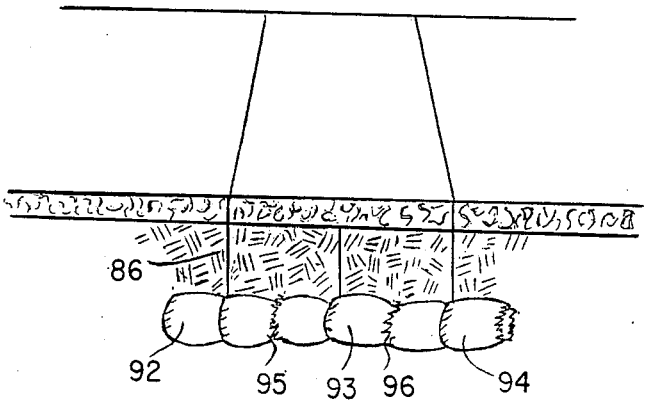
FIGS. 12 and 13 show a plurality of bag or box-like elements joined together forming a unitary structure and such a structure disposed between two liner layers the top one of which can be that of an impoundment or a cover for a pond, there being between the two liner layers a mass of weighting materials in which said unitary structure is embedded.

Referring to FIG. 12 there are shown bag-like elements 92, 93 and 94 seamed together at 95 and 96, thus forming a unitary, compartmented arrangement. FIG. 1 shows such arrangement embedded in a layer of weighting material above a liner layer and below an upper one.

Figure 13:
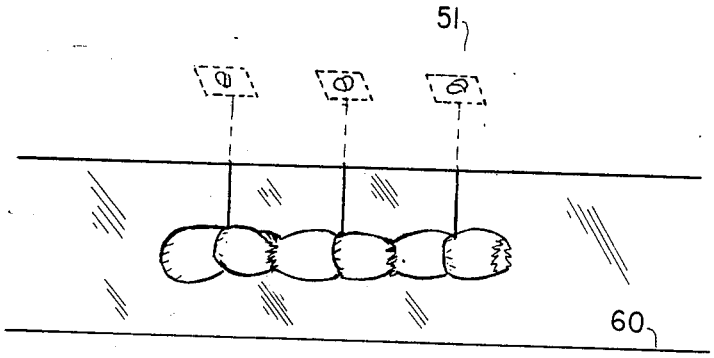

In lieu of, or in addition to, in-ground anchors, ballast or bags, etc., there can be provided between the liners in FIG. 7 earth, aggregate, clay or other filler to hold down or to aid in holding down the lower liner. This filler or other material can be in lieu of or in addition to the weighting material shown in FIG. 14. Preferably to support the upper liner as when it carries a load, i.e., a liquid or even an inspection vehicle which may be rolled or driven thereover, the space between the liners will be substantially completely solidly filled with a suitable filler, thus to protect the upper liner against damage by indentation. It is necessary for holding down the upper liner to provide only sufficient weighting material in the respective areas at which escutcheons, as 76 in FIG. 9, or a unitary structure as shown in FIG. 13, or other holders or their elements are located. Suitably, inspection vehicles or other loads which may cause indentation will be moved on the liner at only those places where protection against indentation has been made.

In the event there is not to be provided any significant amount of space between the two liner layers, as constructed, the upper layer or liner can be bonded to the lower layer which will be anchored with in-ground anchors, according to the invention.

In the event an anchor rope, as at 57 and anchor plate 58, or means similar in function thereto is not installed as when constructing a system to cover expensive to dig out solid rock, filler material will be placed also surrounding webs as shown at 54, if there is to be a significant space between the liners.

Combinations or pairs of retaining or holding member configurations as shown in FIG. 7, etc., can be used to establish a grid pattern to anchor a top liner to a bottom liner, or a succession of liners anchored to each other and the next to the bottom liner anchored to the bottom liner which is anchored beneath the surface of the area to be lined or covered. Liners may be fastened in a grid pattern without the use of rope by applying an interface of adhesive such as a polyethylene hot melt and compressing the two liners together. However, cord or rope is now preferred in most situations to permit movement of the top liner with respect to a liner below it when conforming to the thermal contraction and expansion usually experienced in service and, of course, to put in a filler or weighting material when used. Box or bag-type anchors can be used for anchoring a floating cover of a pond. The lining material in our invention will float and the liner thereof can be used for evaporation control, isolation or collection of fumes or gases, or even as a solar collector.

Anchor types and materials suited to the invention are many. One that may be used is produced by stablizing the lower part of an excavated anchor hole by mixing an epoxy resin with some of the excavated material, encasing the anchor cord and then refilling the hole with the mix and compacting it in the hole. Other stabilizers which can be used in this way include Portland cement, grouts, lime, sulfur, asphalt compounds, etc.

In-ground anchors as shown in FIG. 7 for the bottom liner are an aid to installation of that liner because even mild wind action can be a serious problem in controlling the liner lap material against dislodgement and possible destruction. Also, in-ground anchors will stabilize the liner on slopes wherever encountered as at places at bottom of a large pond or at the side; and relieve stress from any water turbulance that may occur. A weighting material placed over the bottom liner to a depth of approximately six inches to one foot will enable the top liner to be installed in the same manner as the bottom liner with the anchors held within the weighting material and not necessarily attached to the bottom liner. This description also applies to multiple liner layers, i.e., more than two. The embodiments here described are within the scope of at least one claim to the invention appended hereto.

It will be seen that a number of liners can be installed with anchors within weighting material below each liner thus protecting the overall structure against dislodgement by wind or fluid action.

Weighting materials as interfacial additives can be bentonite, chemical jells, and sealing admixtures of various kinds to provide additional sealing protection, particularly where hazardous wastes are a factor. In fact a single liner weighted with a thin layer of bentonite or other material may be desirable in some cases, as in the case of severe usage, in which event the anchoring structure installed can be of a reduced strength, especially when the weighting material is distributed over the liner sections as these are being installed. A cover layer of selected weighting material pneumatically or otherwise applied onto an anchor liner will improve the general impermeability aspect, though may never be necessary. A compartmented, liquid filled, structure as a means to provide weight and stability is within the scope of the claimed invention, and will create divisions within a contained area as a substitute for structural elements, such as wood or concrete.

Further, a series of bags which can be joined or a compartmented weighted structure can be interposed between two or more liners similar to those shown in FIG. 7. Such bags are within the scope of claims appended hereto. Thus, even a structure below a lowest liner is within the scope of the appended claims and such bags or box-like structures will be disposed in grid-like manner. Still further, web portions can be bonded between liners at the selvages or seams, creating walls of which the ceiling and floor portions are constituted by the liners. The bonding or joining of elements of the claimed structure can be effected in any manner, e.g., by heat-sealing, use of a bonding material, or by stitching. Any stitching which has been described as in the case of forming a selvage, can be heat-sealed or otherwise rendered fluid impermeable in any known manner.

As noted, the grid anchoring system of the invention as herein described and claimed in the appended claims, is designed to stabilize during and after installation any area of the membrane liner which is to be fully, partially, or temporarily, as during construction, exposed to the atmosphere and subject to damaging energies extant in wind lift, gas flotation, and ground water upthrust. The stabilized area can be complete coverage for any size structure such as ponds, closures, landfills, and other impoundments or ground covers even as indicated in column (now p.6) hereof. The area can be as small as ten square yards to many acres. Any area designed to be covered by a liner capable of being joined by a seamed, cemented, or welded structure to which an anchor device can be affixed underneath the liner, can be installed without concern that physical damage will result which unstabilized, exposed liners are difficult, if not impossible, to guard against.

Grid anchors can be spaced underneath and particularly along the same juncture at intervals of from about one foot to about fifty feet, or even more, depending upon conditions which include the use of weighting materials. About twelve to about fifteen feet is now considered an optimum for both economic and physical reasons. Longitudinal space intervals matching the transverse width of the liner panel will give the best distribution of resistance so that whatever the direction of disturbing energy the same anchoring capability exists at all points, i.e., 10×10'; 12×12' and 15×15' being grid distributions based on panel widths. Grid spacing in excess of fifteen feet is less desirable because in some cases wind will cause rippling, rolling, or wave action which tends to cumulatively increase in size and cause damage by distortion and strain on the membrane liner. The fifteen foot grid spacing controls or dampens this action so that the rolling does not occur, thus avoiding damage.

Routine testing and/or further experience will determine for each kind of application and/or conditions the optimum, economical grid spacing.

Thus, foundation soils very greatly in their resistance to the displacement of therein buried anchor segments subjected to vertical uplift forces. In most prepared pond or landfill basin installations the foundation or substrate is sand, clay, or mixtures of the two. The resistance is determined by the consolidation characteristics of the soil, whether it is loose, dense, dry, damp, or saturated. The in-place soil properties will determine the effective profile or surface area of the buried anchor segment needed to withstand the pull of a three-hundred pound test cord attached thereto at a depth of about one foot; an economical as well as a physical depth in which mechanical anchor setting and soil compacting can be realized. In some rare situations, anchor depths of as little as six inches will hold, for example in rock or extremely dense material, when the profile or surface area of the anchor segment can be as little as twenty square centimeters. Since sand and often loosely consolidated or compacted materials are frequently encountered, the anchor surface area must be determined by tests at the site. For example, dry sand of the beach variety is unstable, and an anchor of at least one-hundred square centimeters will be required to withstand a three-hundred pound pull when buried one foot deep. Damp sand is much more stable and an anchor segment of fifty square centimeters will suffice. However, this same sand if subjected to ground water pressure will become saturated and tend to become decompacted thus becoming unstable, requiring an anchor segment of at least one hundred square centimeters. Accordingly, the anchor surface area selected will be the largest consistent with the most unfavorable condition to be expected in the substrate. This applies to varigated foundation conditions such as an excavated basin which consists of cut and fill material as when a basin is in part prepared by cutting from a hillside and the bottom is part rock, and rock and fill. The anchor surface area selected should fit the least stable condition, at least wherever it occurs if all anchors are to be chosen to the same size to avoid mistakes in installing the grid pattern. It was found that less than fifteen-square centimeter anchor segments would not hold satisfactorily in wind gusts of twenty to fifty miles an hour, using anchoring spacings within the measurements above set out. Thus, a three-hundred pound test anchor cord would pull the anchor from a substantially dense soil. By increasing the surface to thirty-square centimeters the anchor would hold without displacement up to a pull strength at which the three-hundred pound test cord would break when testing just one anchor in a static test.

Although somewhat lesser strength cord could be used, the three-hundred pound test cord at an anchor depth of one foot on a twelve-foot grid will regularly withstand winds in excess seventy miles per hour without displacement. The now preferred three-hundred pound test cord is made of polypropylene which is used also in structuring the retaining or holding members according to the invention.

We have further determined that the top anchor plate (FIG. 4 at 18) and liner seam portion to which it is affixed by means of the polypropylene cord can be selected from available materials such as herein described that will also withstand even in excess of three-hundred pounds without tearing or other damage. The top anchor piece or plate is preferably of high density polyethylene for optimum resistance to chemical action, biodegradation, etc. The plate size can be of varying lengths and widths as well as diameters or thicknesses. For example, the anchor plate used along the seamed edge found to resist the three-hundred pound pull will measure ten centimeters in length, two centimeters in width, and will be five millimeters thick, with three six-millimeter holes spaced four centimeters apart from the center and each side thereof. The plate length can vary from as little as about five centimeters to as long as two meters or more and will, of course, accomodate more holes. The width can vary from about one centimeter to as much as ten centimeters or more depending upon what the selvage desired will accomodate. Thickness, depending upon material, can vary from about one millimeter to about four centimeters or more.

Obviously, the liner material itself must be able to withstand forces acting on it. This is why it is important, indeed critically important to keep it from moving so that it will not acquire momentum which will increase or multiply the effect of the force or forces acting upon it. Clearly, if the liner cannot acquire any real momentum it need not be as strong or resistant to tearing, etc., and this permits a real savings in cost and materials.

Wind energies which do not appear to respond to special formula are given in general terms of velocity, steady or intermittent, and such behavioral descriptions. Atmospheric thermal conditions usually influence the wind. Gusts of thirty miles per hour will displace even the heaviest of liner materials unless truly stabilized. When properly anchored on a grid system according to the invention winds of one hundred miles per hour will not cause liner damage. The angle at which the wind acts upon the liner is influenced by the ground topography. The shape of, say, impoundment structures creates wind lift, suction, or air-foil effect as wind passes over the structure, especially at embankments. At an angle, turbulence can cause both suction and pressure forces creating in an unstabilized liner a rolling or whipping action which becomes increasingly active as wave-like it progresses across the basin. This action causes an area of severe bulging at the downwind side usually resulting in seam damage or liner tearing if not controlled by effectively stabilizing the liner. If air can enter below the liner, as at a torn seam, the entire liner can be displaced even to its complete destruction. Air or gas vents are a standard practice and can be helpful since a slight vacuum is pulled by the wind therethrough. With the anchored system of the invention the underliner air is controlled. Yet, without the anchor grid system of the invention air can be drawn through the vents allowing the wind to lift or balloon the liner. Thus, vents can be detrimental to an unanchored system. It has been argued that no vents should be used when wind lift is a problem. However, unvented, unstabilized liners have been lifted so that their own weight has torn seams apart or tear through the material permitting wind to enter and the liner carried off or otherwise damaged. Even unvented, anchoring will control wind lift. Venting is primarily intended to control gas lift to avoid rising up of the liner as earlier set out herein. The anchored liner provided by our invention directs accumulating gas across the bottom of the structure between the liner and the ground or foundation onto which the liner is fixed and up any slopes and out vent openings.

EXAMPLE 1

An example of an actual installation, typical of the embodiment of the invention, showing the useful parameters involved, was of an irregular shaped ornamental pool located in deep river sand close to the Arkansas River. An exposed lining was required and a system of the invention was accepted because it was believed it could be kept in place whereas others could not without an earth cover which, of course, would not have permitted the required exposed lining. The dimensions of the pool are here squared off for simplification. The length of this existing pool is about 200′ and the width 60′. The bottom slopes from 4′ at one end to about 8′ at the other. The construction procedure involved placing two twelve-foot wide liner panels, one on top of the other. Each panel had a polyethylene facing or layer. The panels were laid, polyethylene faces matching, transversely across the bottom of the basin. The panels were sewn together at one of their transversely positioned edges forming a 1½″ selvage, grommet holes were made in the selvage and an anchor top plate, or piece, fixed to the liner at the selvage by means of a 24″ section of a 300 lb test polypropylene cord, the lower end of which was secured to a 100 sq. cm. anchor plate of high density polyethylene 180 mils thick. Anchors were buried to a depth of one foot into the dry sand and the sand compacted as well as conditions would permit. An anchor was tested for resistance to dislodgement before attaching the rope to the selvage. Placed at intervals of twelve feet along the selvage across the basin the anchors held securely. The top panel was then folded and another placed on top of the folded-over panel, sewn, anchored, and also folded over. The just described operation was repeated until the entire basin was lined. The peripheral edges of the liner were secured in a peripheral trench one foot deep. The trench was back filled and compacted. During the installation some 80 sq. cm. surface area plates were also installed and found to be satisfactory. A 30 sq. cm. anchor pulled out, but with difficulty. A 20 sq. cm. anchor released with approximately 60 lb pull. It was apparent that increased surface at right angle to the direction of pull was necessary and each installation would have to be checked accordingly. In view of the foregoing the "standard" anchor piece or plate that we had previously used, which was just under 20 sq. cm., was abandoned as inadequate. Another installation, priorly made, also showed that the abandoned standard piece was inadequate when a number of anchors released with 60 mph wind gusts and had to be replaced. From our experiences above set out we concluded that shape and weight are of little consequence in anchor design and that surface area at right angle to the direction of pull is the important factor in testing for displacement resistance. Also, that a 300 lb test is adequate to assure sufficient strength.

EXAMPLE 2

This is a calculated or designed example. A typical small pond 100×100′ with 3 to 1 slopes is designed to show anchor spacing at ten-foot intervals on ten-foot wide liner panels. The anchors are set one foot in the ground. The panels are entrenched at the periphery at the tops of the slopes at which gas vents, two on each side, are provided. This liner will be capable of withstanding 100 mph winds as frequently encountered in the west Texas plains area where the soil, which is usually caliche, will have good holding for a 30 sq. cm. surface area anchor segment, enough to resist effectively up to about a 300 lb pull or tension in that soil. Each anchor functions independently to control an aliquot portion of the liner surrounding the anchor location.

In view of the natures of the several and variously combinable elements and/or embodiments of the invention which have now been described, it will be seen by one skilled in the art, that the selection of the best mode for his purposes will depend upon factors evident to him from this disclosure.

However, costs aside, the best mode now contemplated and being advocated is the embodiment involving two, or more, liners plus the anchors as illustrated in FIG. 7.

The best mode for executing the invention, i.e. putting it into actual use will depend upon the facts and circumstances of the particular use to be served. As in the case of most inventions, especially those requiring a construction to meet certain conditions of usage, costs, etc., the routineer will seek to determine the optima fitting in with his objectives. However, for the best results the system of the invention will be installed constructing at least two liners, especially if the liner material or materials selected are to be such that the impoundment, or other earth covering is expected to last a long time and/or to be put to severe conditions of usage. In the event that a plurality of liners is used to construct the invention the lowermost liner will be anchored as shown in the drawings and an upper liner will be anchored with an anchoring means or structure, also as evident from the drawings and this disclosure.

It is now evident that the best mode of execution of the invention, that is, the mode selected in view of the particular facts and circumstances extant, will depend upon considerations including wind and soil fluid expected to be encountered by the liner parts as it is being constructed and by the constructed liner or cover when it is in place and subject to usage and even exposed without any material thereon or stored therein, e.g., when a storage area is drained for cleaning out the bottom onto which diret, debris, etc., have settled over a period of time. The nature of the soil, the angles of any slopes and all other physical considerations or conditions which the engineer planning the execution routinely will take into account; indeed, factors affecting the planning and execution of any construction or operation.

Reasonable variation and modification are possible within the scope of the foregoing disclosure, including the drawings, and the appended claims to the invention the essence of which is that there have been provided a liner or covering system or structure and a method for constructing the same, said system having an impervious liner layer having a substantial portion of its area exposed to the atmosphere, said layer being held in position able to withstand dislodgement or damage by wind and/or ground fluid, said system comprising a liner layer acting to contain, retain, or to fend off a fluid or liquid from contact as with earth or other substance below it; an anchoring means or structure; said liner layer being held down in a fixed, desired position from underneath by said anchoring means or structure in a manner such that at each exposed loci of said liner layer the retaining or fixing strength of said anchoring means or structure acting from underneath said liner layer to fix said liner layer in said position is at least equal to the maximum force of said wind and/or fluid expected to act at any time at said loci regardless of whether any force is acting at said time at any other said loci of said liner layer; said liner being held by said anchoring means or structure at a plurality of such loci, said loci in the now preferred embodiment of the invention being distributed in a grid-like fashion or manner or pattern over such substantial portion of said area exposed to the atmosphere: said method comprising laying on the ground or other substance to be covered, one atop the other, at least two liner layer sections or laps in a manner that at least one edge of each lap is adjacent to a corresponding edge of another; attaching said one edge of one of said laps to a corresponding edge of said another as by seaming or bonding, thus to form a seam or joint, which can be selvage-like; providing an anchoring means or structure below said seam; attaching said anchoring means or structure to said seam or lap at a plurality of loci of said lap, preferably along said seam; the spacing along said seam or lap and strength of said anchoring means at each of said loci being such that at each said loci the retaining or fixing strength of said anchoring means or structure acting from underneath said liner layer at said lap or seam, is at least equal to the maximum force of said wind and/or fluid expected to act at any time at said loci regardless of whether any force is acting at any other said loci; and then extending or positioning the now seamed and attached top lap by extending the same from atop said other lap to above said ground or other substance to be covered, thus having formed at least a portion of said liner or covering system; for the now preferred embodiment of the invention the anchoring means or structure at each said loci being able to withstand a substantially upward pull of at least about 300 pounds; said loci being spaced from each other about 1 to about 50 feet, preferably from about 10–12 to about 15 feet, the selected distance between loci, preferably disposed in a grid-like pattern, being related to the amount and nature of the overburden and upwardly presented profile of said anchoring means or structure.

We claim:

1. A system composed by joining together as at their edges, a multiplicity of sections of impervious material comprising: an impervious liner layer of the joined sections which as being installed and joined together and thereafter can have a substantial portion of its area exposed to the atmosphere and which in position of said joined sections is able to withstand dislodgement or damage by wind and/or ground fluid, said liner layer being adapted to contain, retain, or to fend off a fluid from contact as with a substance below it; non-liner perforating anchoring means all of which is disposed entirely below said liner layer; said liner layer being attached to said anchoring means at a plurality of loci distributed throughout the area espoused by said portion of said system; said anchoring means being adapted to hold down and holding down said liner layer entirely from below said liner layer at each of said plurality of loci of said liner layer in a stable, fixed, desired position and in a manner such that at each said loci of said liner layer the acting fixing strength of said anchoring means is at least equal to the maxiumum force of said wind and/or fluid expected to act at any time at said loci regardless of whether any force is acting at said time at any other said loci of said liner layer; said loci being arranged at places at which said sections are joined together.

2. A system according to claim 1 where said liner layer is composed of several sections or laps, said laps are seamed, bonded or stitched together at least at one edge of each to the other and said anchoring means or structure is attached to the seam, bond or stitching.

3. A system according to claim 2 wherein said laps are so seamed, bonded or stitched together as to form a selvage and said anchoring means or structure is attached to said selvage.

4. A system according to claim 3 wherein said selvage is grommeted, said anchoring means or structure comprises retaining or holding members and said holding members are attached to said selvage at the grommets.

5. A system according to claim 1 wherein said anchoring means or structure comprises an anchor member and rope and said rope is attached at said loci.

6. A system according to claim 5 wherein said holding member is plate-like.

7. A system according to claim 5 wherein said anchor member is adapted to spread out and to lock into the walls of a hole into which it is buried under an overburden responsive to force exerted on said anchor by said rope and wherein said anchor is buried in said hole under said overburden.

8. A system according to claim 1 having at least two liner layers, wherein an upper layer is anchored as said first-mentioned liner layer to a lower liner layer; said lower liner layer is provided with holding down means; and wherein said holding down means holds down said lower liner layer in a manner to provide an overall liner system which is fixed and stable against said damage.

9. A system according to claim 8 wherein at least one of said liner layers is seamed, bonded or stitched together; at least one web-like member is held at or in the seam, bond or stitching; and said anchoring means or structure comprises retaining or holding members; and said members are attached to said web-like member.

10. A system according to claim 1 wherein said liner layer is composed of several laps or action seamed, bonded or stitched together; a trench or ditch is disposed beneath a plurality of said loci; said trench comprises a weighting material; an anchor is disposed in said material; and said anchor is fixed or attached to at least one of said loci.

11. A system according to claim 10 wherein said trench is lined with a filter fabric; said trench comprises a weighting material which permits ground fluid to enter into and move through it as for drainage and said fabric is tautly and fixedly attached to at least one of said laps or section, thus anchoring said liner layer at said loci.

12. A system according to claim 1 wherein said anchoring means or structure comprises a weighted, closed box or bag-like element; a retaining or holding member; and said retaining or holding member is fixed to said liner layer to hold down said liner in stable, fixed position.

13. A system according to claim 12 wherein a plurality of elements is provided and the elements are joined together as by seaming, bonding or stitching thus forming a unitary, compartmented arrangement.

14. A system according to claim 8 wherein said anchoring means or structure comprises escutcheon-like elements at least two of which face each other by their apices and have a rope or cable knotted at its ends between them, the knots being espoused within the bells of said escutcheons; the rope or cable is of suitable length to fix said liner layers together as desired; and the escutcheons are fixed, attached or bonded respectively to each of said liner layers thus holding the one to the other in a stable, fixed position.

15. A system according to claim 8 wherein said anchoring means or structure comprises a weighted, closed box or bag-like element, said element is disposed between two liner layers; said element is provided with a retaining or holding member; and wherein said retaining or holding member is fixed to at least one liner layer thus anchoring said liner layer to hold it down in stable, fixed position.

16. A system or structure according to claim 1 wherein said anchoring means or structure at said plurality of loci holds down said liner at points distributed substantially in or forming a grid-like pattern.

17. A system according to claim 1 wherein said anchoring means of structure at each said loci is able to withstand a substantially upward pull of at least about 300 pounds; wherein said loci are at points distributed substantially in a grid-like pattern; the distance between said loci in installed position of the completed liner in said grid-like pattern is related to the amount and nature of the anchoring force or overburden acting upon said anchoring means or structure and the upwardly presented profile of said anchoring means or structure; and said distance between said loci being from about 1 to about 50 feet, preferably from 10–12 to about 15 feet.

18. A method for constructing atop the ground or other substance to be covered an impervious liner layer system composed by joining together as at their edges a multiplicity of sections of impervious material which can as being installed and joined together and thereafter have a substantial portion of its area exposed to the atmosphere and which is held in position able to withstand dislodgement or damage by wind and/or ground fluid, said liner layer being able to contain, retain, or to fend off a fluid or liquid from contact as with earth or other substance below it which comprises: laying atop the ground or other substance to be covered, one atop the other, at least two liner layer sections in a manner that at least one edge of each section is adjacent to a corresponding edge of another section or lap; attaching said one edge of one of said sections to a corresponding edge of said another section or lap as by seaming or bonding, forming a seam or joint; providing anchoring means for the structure below the thus joined sections substantially at said seam or joint; attaching said anchoring means or structure at a plurality of loci to a portion of said sections substantially at said seam or joint in a manner arranged so that in installed position of the completed liner layer all of the anchoring means or structure will be underneath said liner layer; the spacing and strength of said anchoring means at each of said loci being such that the retaining or fixing strength of said anchoring means or structure acting at each said loci from underneath said joined sections will be at least equal to the maximum force of said wind and/or fluid expected to act at any time at said loci thus holding down said liner layer at each said loci in a stable, fixed position regardless of whether any force is acting at any other of said loci, and then placing the top lap in final position by folding and extending it over to lie in its attached condition adjacent the section to which it has been seamed or joined.

19. A method according to claim 18 wherein the seaming or bonding of said laps or sections is accomplished to provide a selvage and said anchoring means or structure is attached to said selvage.

20. A method according to claim 19 wherein a web-like member is secured at said selvage; a retaining or holding member is provided as part of said anchoring means or structure; and said holding member is fixed to said web-like member.

21. A method according to claim 18 which comprises excavating a trench in proximity and below said loci and anchoring at least one lap by anchoring means in or at said trench.

22. A method according to claim 21 wherein said trench is lined; said lap is attached to said liner and said liner is held securely in said ditch in stable, fixed position.

23. A method according to claim 18 wherein there are provided at least two liner layers; an upper layer is anchored similarly to said first-mentioned liner layer to a lower liner layer; said lower liner layer is provided with holding down means; and wherein said holding down means is provided to hold down said lower liner layer thus to hold said upper layer in stable, fixed position in a manner to provide an overall liner system which is fixed and stable against said damage.

24. A method according to claim 23 wherein there are provided at least two liner layers; there are also provided at least two escutcheons facing each other at their spices; a rope or cable of suitable length is knotted at its ends, the knots being encompased within the bells of said escutcheons respectively; and said escutcheons are attached or bonded respectively to each of said liner layers thus holding the one to the other, as desired.

25. A method according to claim 18 wherein anchoring means at each said loci is able to withstand a substantially upward pull of at least about 300 pounds; wherein said loci are at points distributed substantially in a grid-like pattern; the distance between said loci in installed position of the completed liner as being installed being related to the amount and nature of the overburden acting upon said anchoring means and to the upwardly presented profile of said anchoring means or structure; said distance between said loci being from about 1 to about 50 feet, preferably from 10–12 to about 15 feet; said loci which are disposed substantially in a grid-like pattern being distributed across at least the area of the exposed position of the completed liner layer.

26. A method according to claim 18 wherein said anchoring means for the structure at said plurality of loci is attached to hold down said liner at points distributed substantially in or forming a grid-like pattern.

27. A system composed by joining together as at their edges a multiplicity of sections of impervious material comprising: an impervious liner layer of the fixed together or joined sections which as being installed and joined together and thereafter has a substantial portion of its area exposed to the atmosphere and which in position of or joined section is able to withstand dislodgement or damage by wind and/or ground fluid, said liner being adapted to contain, retain, or to fend off a fluid from contact as with earth or other substance below it; anchoring means disposed entirely below said liner layer; said liner layer being attached to said anchoring means at a plurality of loci distributed throughout the area espoused by said portion of said system; said anchoring means being adapted to hold down and holding down said liner layer from below it at each of said plurality of loci of said liner layer in a stable, fixed desired position and in a manner such that at each loci of said liner layer portion the acting retaining or fixing strength of said anchoring means is at least equal to the maximum force of said wind and/or fluid expected to act at any time at said loci regardless of whether any force is acting at said time at any other said loci of said liner layer; said loci being arranged at places at which said sections are joined together and wherein said anchoring means said plurality of loci holds down said liner at loci distributed substantially in or forming a grid-like pattern over substantially the entire portion of its area exposed to the atmosphere.

28. A system composed by joining together as at their edges a multiplicity of sections of impervious material comprising: an impervious liner layer of the fixed-together or joined sections which as being installed and fixed or joined together and thereafter has a substantial portion of its area exposed to the atmosphere and which in position of said joined sections is able to withstand dislodgement or damage by wind and/or ground fluid, said layer being adapted to contain, retain, or to fend off a fluid or liquid from contact as with earth or other substance below it; anchoring means or structure disposed entirely below said liner layer; said liner layer being attached to said anchoring means at a plurality of loci distributed throughout the area espoused by said portion of said liner layer; said anchoring means or structure being adapted to hold down and holding down said liner layer entirely from below it at each of a plurality of loci of said liner layer in a stable, fixed desired position and in a manner such that at each loci of said liner layer portion the acting retaining or fixing strength of said anchoring means is at least equal to the maximum force of said wind and/or fluid expected to act at any time at said loci regardless of whether any force is acting at said time at any other said loci of said liner layer said loci being arranged at places at which said sections are fixed or joined together; wherein said anchoring means at said plurality of loci holds down said liner at loci distributed substantially in or forming a grid-like pattern over substantially the entire portion of its area exposed to the atmosphere; wherein said sections are so seamed or bonded together as to form a selvage-like portion between said seaming or bonding and the edges of said joined sections; and wherein said anchoring means is attached to said selvage-like portion.

29. A method for constructing atop a substance to be covered an impervious liner layer system composed by joining together as at their edges a multiplicity of sections of impervious material which has as being installed and joined together and thereafter a substantial portion of its area exposed to the atmosphere and which is held in position able to withstand dislodgement or damage by wind and/or ground fluid, said liner layer being able to contain, retain, or to fend off a fluid from contact as with earth or other substance below it which comprises: laying atop the substance to be covered, one atop the other, at least two liner layer sections in a manner that at least one edge of each section is adjacent to a corresponding edge of another section; attaching said one edge of one of said sections or laps to a corresponding edge of said another section as by seaming or bonding, forming a seam or joint; providing anchoring means for the structure below the thus joined sections substantially at said seam or joint, attaching said anchoring means at a plurality of loci to a portion of said sections substantially at said seam or joint in a manner arranged so that in installed position of the completed liner layer all of the anchoring means or structure will be entirely underneath said liner layer; the spacing and strength of said anchoring means at each of said loci being such that the retaining or fixing strength of said anchoring means acting at each said loci from underneath said joined sections will be at least equal to the maximum force of said wind and/or fluid expected to act at any time at said loci thus holding down said liner layer at each said loci in a stable, fixed position regardless of whether any force is acting at any other of said loci, and then placing the top lap in final position by folding and extending it over to lie in its attached condition adjacent the section to which it has been seamed or joined, wherein the seaming or bonding is accomplished to provide a selvage-like portion between said seaming or bonding and the edges of said joined sections and wherein said anchoring means is attached to said selvage-like portion before the top section is placed or folded over into its final position, thus completely positioning and covering said selvage-like portion and said anchoring means.

* * * * *